United States Patent [19]

Neuber et al.

[11] 4,111,507

[45] Sep. 5, 1978

[54] APPARATUS FOR HIGH VOLTAGE CONDITIONING CATHODE RAY TUBES

[75] Inventors: Ralph E. Neuber; Charles H. Rehkopf, both of Seneca Falls, N.Y.

[73] Assignee: GTE Sylvania Incorporated, Stamford, Conn.

[21] Appl. No.: 796,744

[22] Filed: May 13, 1977

[51] Int. Cl.[2] ..... H01J 9/44

[52] U.S. Cl. ..... 316/27; 339/111; 339/117 R

[58] Field of Search ..... 361/327; 339/111, 117 R; 316/1, 27

[56] References Cited

U.S. PATENT DOCUMENTS 2,947,926 8/1960 Murch ..... 361/327

*Primary Examiner*—Richard B. Lazarus

*Attorney, Agent, or Firm*—Thomas H. Buffton

[57] ABSTRACT

Apparatus for high voltage conditioning cathode ray tubes having internal electrodes connected to external base pins includes a container having a pair of electrical contact members therein and passing therethrough to a high voltage potential source and to a conditioning potential source with a liquid having a dielectric strength greater than the dielectric strength of air disposed within the container for immersing the base pins therein to effect contact thereof with the electrical contact members of the container.

The high voltage conditioning of the cathode ray tube is effected by a process which includes the steps of indexing a cathode ray tube and first container having electrical contact members therein surrounded by a liquid having a dielectric strength greater than the dielectric strength of air to effect immersion of the base pins of the cathode ray tube in the liquid and contact thereof with the contact members of the container and indexing the cathode ray tube and a second container containing contact members connected in common to circuit ground to effect arcing to all of the cathode ray tube electrodes in common.

10 Claims, 6 Drawing Figures

APPARATUS FOR HIGH VOLTAGE CONDITIONING CATHODE RAY TUBES

BACKGROUND OF THE INVENTION

This invention is directed to an apparatus and process for high voltage conditioning cathode ray tubes and more specifically to effect high voltage conditioning of cathode ray tubes having a tendency to arc between the external base pins rather than between the internal electodes of the cathode ray tube.

In the field of cathode ray tube manufacturing and particularly the manufacture of cathode ray tubes suitable for television receivers, it is common practice to apply a high voltage potential to the electrodes during the manufacturing process in order to remove undesired contaminents and protuberances from the electrodes. As is well known, such high voltage conditioning or "spot knocking" tends to inhibit the occurrence of interelectrode arcing during normal operation of the cathode ray tube. As a result, undesired and unsightly flashes on the viewing screen as well as deleterious and sometimes catastrophic effects on associated operating circuitry are eliminated or at least reduced by the high voltage conditioning process.

Previously and presently in many types of cathode ray tubes being manufactured, it was and still is a common practice to apply a high voltage potential to an anode electrode sealed into the funnel-like portion of the cathode ray tube. The remaining internal electrodes are connected in common to circuit ground or to a conditioning potential source affixed to the base pins of the cathode ray tube. Thus, arcing is effected at the gap intermediate the anode and the remaining electrodes internal to the cathode ray tube.

Although the above-mentioned technique has been and still is extensively employed, it has been found that such techniques are not satisfactory for some cathode ray tube structures. More specifically, cathode ray tube structures such as the so-called tri-potential focus type cathode ray tube utilize relatively high potentials during operation and these high potentials are applied to the internal electrodes by way of the external contacts or base pins. Since these electrodes are subjected to relatively high potentials during operational use, it is imperative that each electrode and the gaps intermediately adjacent thereto be subjected to high voltage conditioning during the manufacturing process in order to remove undesired particles and protuberances from the electrodes prior to the normal operating experience.

Unfortunately, it has been found that coupling all of the electrodes in common to a conditioning potential souce and an anode electrode to a high voltage potential source does not provide the desired internal conditioning of each of the electrodes. Rather the gap intermediate the anode and the commonly connected grid electrodes appears to be the only area whereat the desired conditioning is effected.

Moreover, when one attempts to apply a conditioning potential to individual grid electrodes by way of the base pins, it has been found that arcing tends to occur externally at the base pins rather than internally at the electrodes. In other words, the external contacts or base pins tend to arc at lower potentials than are required to effect arcing intermediate the electrodes internal of the cathode ray tube.

OBJECTS AND SUMMARY OF THE INVENTION

Therefore, it is an object of the present invention to provide apparatus for overcoming the above-mentioned inadequacies of the prior art. Another object of the invention is to enhance the high voltage conditioning of a cathode ray tube. Still another object of the invention is to provide improved high voltage conditioning for cathode ray tubes having structures which tend to arc intermediate the external base pins at a potential level lower than the potential level whereat arcing intermediate internal electrodes occurs. A further object of the invention is to provide inexpensive apparatus and processing means for high voltage conditioning cathode ray tubes having a tendency toward external base pin arcing rather than internal electrode arcing.

These and other objects, advantages and capabilities are achieved in one aspect of the invention by apparatus wherein a container includes a pair of electrical contact members connected to a high potential source and to a conditioning potential source and are formed for connection to the external base pins of a cathode ray tube. A liquid having a dielectric strength greater than the dielectric strength of air is disposed within the container and surrounds the pair of electrical contact members and the base pins of the cathode ray tube.

In the process, a first container having a pair of contact members connected to high voltage and pulsed conditioning potential sources and including a liquid having a dielectric strength greater than the dielectric strength of air is indexed to immerse the base pins of the cathode ray tube in the liquid and in contact with the contact members of the container and then a second container having a pair of contact members connected in common to a potential reference level is indexed to effect contact of the base pins of the cathode ray tube and the contact members of the container.

PREFERRED EMBODIMENTS OF THE INVENTION

For a better understanding of the present invention, together with other and further objects, advantages and capabilities thereof, reference is made to the following disclosure and appended claims in connection with the accompanying drawings.

Figure 1:
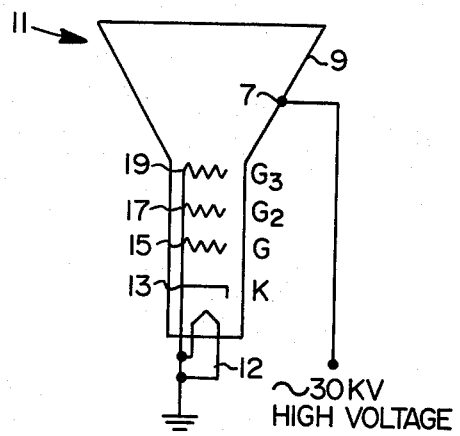
FIG. 1 is a symbolic illustration of the electrical connections employed in one form of high voltage conditioning for cathode ray tubes.

Referring to the drawings, FIG. 1 illustrates the electrical connections normally employed in prior art conditioning of cathode ray tubes. Therein, an anode button or high voltage electrode 7 is affixed to the funnel-portion 9 of a cathode ray tube 11. The filaments, cathode, grid 1, grid 2, and grid 3 electrodes, 12, 13, 15, 17 and 19 respectively, are connected in common and potentials are applied such that arcing occurs between the anode button 7 and the commonly connected electrodes 12, 13, 15, 17 and 19.

Figure 2:
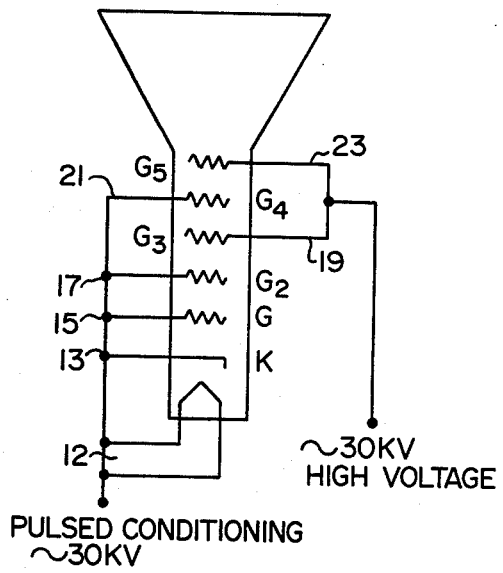
FIG. 2 is a symbolic illustration of electrical connections employed in high voltage conditioning a cathode ray tube of the tri-potential focus type especially suitable to the apparatus of the invention.

However, in the tri-potential type cathode ray tube illustrated in FIG. 2, it is essential to effect arcing intermediate adjacent grid electrodes internal of the cathode ray tube. More specifically, the tri-potential type cathode ray tube not only includes an anode button 7 in the funnel portion 9 and a heater, cathode, grid 1, grid 2, and grid 3 electrodes, 12, 13, 15, 17 and 19 but also includes a grid 4 and a grid 5 electrode, 21 and 23 respectively. More importantly, the grid 4 electrode, 21 and the adjacent grid 3 and grid 5 electrodes 19 and 23 are normally subjected to a relatively high potential, such as 6 KV and 12 KV respectively for example, which necessitates removal of any protuberances from the grid 4 electrode 21 as well as from the adjacent grid 3 and grid 5 electrodes 19 and 23 prior to operational utilization of the cathode ray tube.

Figure 3:
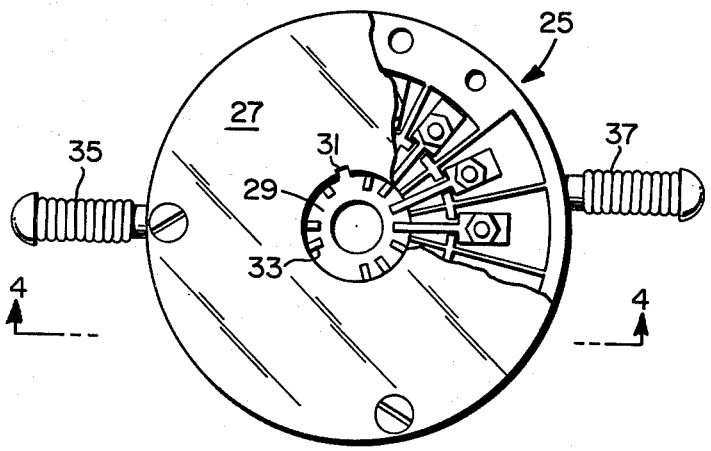
FIG. 3 is a plan view of a socket suitable for attachment to a cathode ray tube and for electrically coupling the cathode ray tube base pins to a potential source.

In one preferred method for achieving the above-described arcing intermediate the internal electrodes of a cathode ray tube, a socket member 25 of FIG. 3 includes a top plastic plate 27 having a central aperture 29 with an index key 31 therein for receiving the base of a cathode ray tube. The socket member 25 includes a plurality of clip members 33 each formed to contact a base pin member of the cathode ray tube. Moreover, the clip members 33 are selectively connected to a pair of external electrical contacts 35 and 37.

Figure 4:
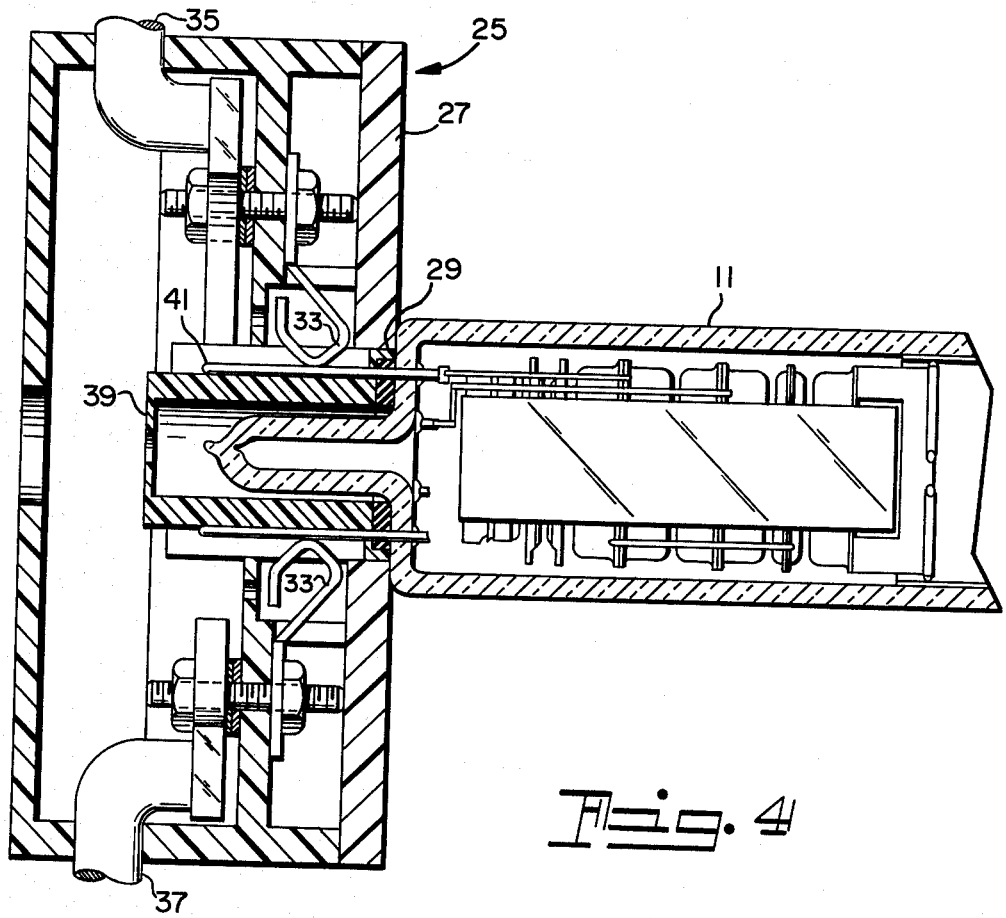
FIG. 4 is a cross-sectional view of the socket of FIG. 3 and includes interconnection of the socket and a cathode ray tube.

As can more readily be seen in the cross-sectional illustration of FIG. 4, a cathode ray tube 11 has a base with a keyed lug member 39 and a plurality of spaced pin members 41. The base of the cathode ray tube 11 is inserted into the aperture 29 of the top plastic plate 27 of the socket member 25. The clip members 33 of the socket member 25 aperture each of the pin members 41 intermediate thereto and the base with the keyed lug member 39. In turn, each one of the clip members 33 is selectively connected to one of a pair of external electrical contacts 35 and 37. Thus, all of the pin members 41 are selectively connected to one or the other of the external electrical contacts 35 and 37.

Figure 5:
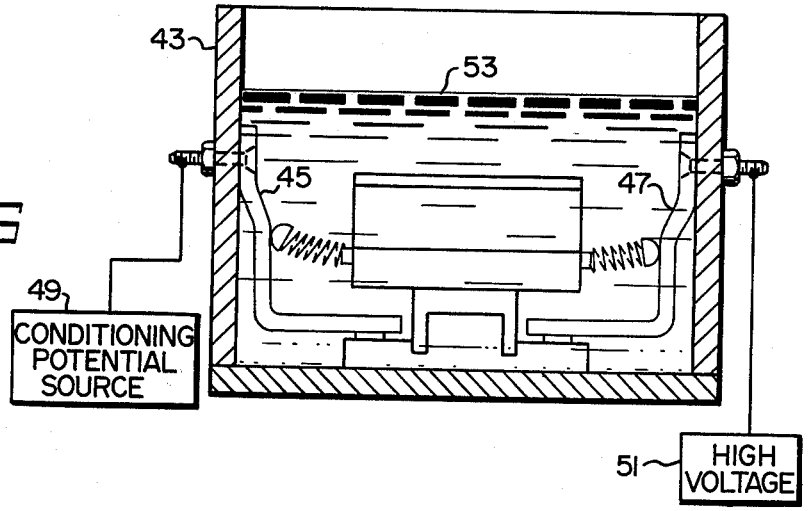
FIG. 5 is a cross-sectional view of a container having a socket member therein immersed in a liquid.

Further, FIG. 5 illustrates a container 43 wherein is disposed a pair of electrical contact members 45, sealed into and passing through the container 43 and electrically connected to a conditioning potential source 49. The other electrical contact member 47 is also sealed into and passes through the container 43 and is electrically connected to a high voltage potential source 51.

Additionally, the container 43 has disposed therein a liquid 53 having a dielectric strength greater than the dielectric strength of air. Preferably, the liquid is in the form of Freon having a dielectric strength greater than 12,000 megohm-cm at 77° F. and 1000 cycles/sec. Alternatively, oil and other liquids may be utilized within the container 43 so long as the dielectric strength thereof is greater than the dielectric strength of air. However, it has been found that Freon liquid is especially suitable due to the ease of removal and the resultant cleanliness of parts which were immersed therein.

Figure 6:
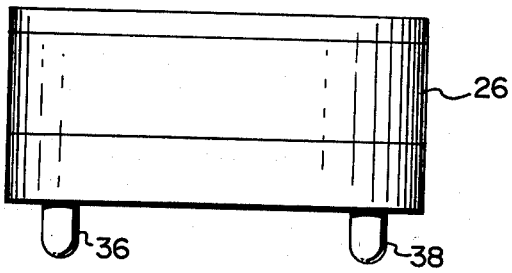
FIG. 6 is a cross-sectional view of an alternate form of socket having a different electrical contacting means.

Also, the socket member 25 is disposed within the container 43 and immersed in the liquid 53. The external electrical contacts 35 and37 are placed in touch with the electrical contact members 45 and 47 respectively and provide electrical conductivity therebetween. Moreover, the socket member 25, in a manner substantially as illustrated in FIGS. 3 and 4, provides electrical connections to external base pins of a cathode ray tube. Also, FIG. 6 illustrates an alternative socket member 26 wherein the external electrical contact members 36 and 38 are formed to rest upon and contact the electrical contact members 45 and 47 of the container 43.

As to the operation, the container 43 is filled with a liquid 53 and the electrical contact members 45 and 47 are connected to the conditioning potential source 49 and to the high voltage potential source 51. Also, the socket member 25 is fitted onto the base of a cathode ray tube, not shown.

Thereafter, the container 43 and a cathode ray tube (not shown), are indexed in a manner to provide electrical connection between the external electrical contacts 35 and 37 of the socket member 25 and the electrical contact members 45 and 47 of the container 43. Moreover, the socket member 25 wherein is disposed the pin members 41 of the cathode ray tube is immersed in the liquid 53. The high voltage potentials and the conditioning potentials are applied to the electrodes of the cathode ray tube in a manner substantially as illustrated in FIG. 2.

Thereupon, the desired arcing between or conditioning of the internal electrodes is effected and undesired arcing between the external pin members 41 is avoided due to the high dielectric strength liquid 53 surrounding the pin members. Thus, arcing between grid electrodes G2 and G3, 17 and 19; grid electrodes G3 annd G4, 19 and 21; and grid electrodes G4 annd G5, 21 and 23 is effected. Moreover, arcing between the anode button 7 and the remainder of the grid electrodes in common is effected by connecting the electrical contacts 35 and 37 together to provide a uniform potential level at the grid electrodes and a HV potential differential between the grid electrodes and the anode button 7. Thereafter, the process is repeated to effect the desired conditioning of the cathode ray tube.

In the process of conditioning the cathode ray tube, the cathode ray tube having external base pins connected to internal electrodes and a fist container 45 having electrical contact members 45 and 47 and containing a liquuid 53 are indexed to immerse the base pins in the liquid 53 and effect contact thereof with the electrical contact members 45 and 47. Also, the electrical contact members 45 and 47 are connected to a conditioning potential source 49 and a high voltage source 51. Thus, arcing between base pins is inhibited by the liquid 53 and arcing between the internal electrodes is desirably achieved.

Thereafter, the cathode ray tube and a second container 43 having electrical contact members 45 and 47 are indexed to effect contact of the base pins with the contact members 45 and 47. However, the contact members 45 and 47 are connected in common to circuit ground or to a reference potential. Thus, desired arcing is achieved between a high voltage potential applied to the anode electrode 7 of a cathode ray tube and the internal electrodes connected in common.

Thus, there has been provided a unique apparatus and method for high voltage conditioning a cathode ray tube. The apparatus permits the utilization of relatively high potential differentials to be applied to adjacent electrodes within the cathode ray tube while inhibiting undesired arcing at the external base pins whereat potentials are most conveniently applied. The employment of a liquid such as Freon greatly reduces problems of cleaning and restoring components to a condition suitable for use in contrast to undesired added cleaning steps frequently encountered with other known liquids. Moreover, the apparatus is most inexpensive and readily available while the process is reliable, economical, and necessitates a minimum equipment and operator training.

While there has been shown and described what is at present considered the preferred embodiments of the invention, it will be obvious to those skilled in the art that various changes and modifications may be made therein without departing from the invention as defined by the appended claims.

We claim:

1. Apparatus for high voltage conditioning cathode ray tubes having spaced internal electrodes each connected to an external base pin and having a resistance to arcing between electrodes greater than the resistance to arcing between the external base pins, said apparatus comprising:

high voltage and pulsed conditioning potential sources;

a container;

a pair of electrical contact members affixed to and passing through said container, one of said pair of electrical contact members being connected to each one of said high voltage and pulsed conditioning potential sources;

means within said container coupled to said pair of electrical contact members for connecting said electrical contact members to said external base pins of said cathode ray tube; and a liquid having a dielectric strength greater than the dielectric strength of air disposed within said container and surrounding said means for connecting said electrical contact members to said external base pins of said cathode ray tube.

2. The apparatus of claim 1 wherein said liquid is in the form of Freon having a dielectric strength greater than the dielectric strength of air.

3. The apparatus of claim 1 wherein said liquid is in the form of Freon having a dielectric strength greater than 12,000 megohm-cm at 77° F and 1000 cycles/sec.

4. The apparatus of claim 1 wherein said liquid is in the form of oil having a dielectric strength greater than the dielectric strength of air.

5. The apparatus of claim 1 including a socket member immersed in said liquid within said container and having a plurality of clip members and a pair of electrical contacts, each one of said clip members being formed to receive a base pin of said cathode ray tube and connected to one of said electrical contacts and each one of said electrical contacts being formed for connection to one of said electrical contact members affixed to said container.

6. Apparatus for high voltage conditioning cathode ray tubes having spaced internal electrodes each connected to an external base pin with the spaced internal electrodes having a greater resistance to arcing therebetween than the resistance to arcing between at least some of the external base pins, said apparatus comprising:

a container;

a pair of electrical contact members affixed to and passing into said container;

a high voltage source and a pulsed conditioning potential source each coupled to one of said pair of electrical contact members;

a socket member disposed within said container, said socket member having a plurality of clip member means which connect to a base pin of said cathode ray tube and a pair of electrical contacts each coupled to said clip member means and to one of said pair of electrical contact members; and a liquid having a dielectric strength greater than the dielectric strength of air disposed within said container and surrounding said clip members of said socket member.

7. The apparatus of claim 6 wherein said liquid is Freon.

8. The apparatus of claim 6 wherein said pair of electrical contacts of said socket member are spring-like members and formed for resilient contact with said pair of electrical contact members passing into said container.

9. The apparatus of claim 6 wherein said pair of electrical contacts of said socket member are substantially rigid members and formed for inflexible contact with said pair of electrical contact members passing into said container.

10. The apparatus of claim 6 wherein said clip member means of said socket member and said electrical contact members passing into said container are immersed in said dielectric liquid in the form of Freon having a dielectric strength greater than 12,000 megohm — cam at 77° F. and 1000 cycles/sec.

* * * * *

UNITED STATES PATENT AND TRADEMARK OFFICE

CERTIFICATE OF CORRECTION

PATENT NO. : 4,111,507

DATED : September 5, 1978

INVENTOR(S) : Ralph E. Neuber and Charles H. Rehkopf

It is certified that error appears in the above-identified patent and that said Letters Patent are hereby corrected as shown below:

Col. 6; Claim 6; Line 29 delete "clip members of" and insert

Signed and Sealed this

*Third* Day of *April 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,111,507

DATED : September 5, 1978

INVENTOR(S) : Ralph E. Neuber and Charles H. Rehkopf

It is certified that error appears in the above-identified patent and that said Letters Patent are hereby corrected as shown below:

Col. 6; Claim 6; line 29 delete "clip members of" and insert -- clip member means of --.

This certificate supersedes Certificate of Correction issued April 3, 1979.

Signed and Sealed this

*Seventeenth* . Day of *July 1979*

[SEAL]

*Attest:*

*Attesting Officer*

LUTRELLE F. PARKER

*Acting Commissioner of Patents and Trademarks*